United States Patent [19]

Mullins, Jr.

[11] 4,132,049

[45] Jan. 2, 1979

[54] METHOD AND APPARATUS FOR BAGGING MATERIAL

[75] Inventor: James N. Mullins, Jr., Fort Worth, Tex.

[73] Assignee: Polar Chips Manufacturing Co., Fort Worth, Tex.

[21] Appl. No.: 827,887

[22] Filed: Aug. 26, 1977

[51] Int. Cl.[2] ..... B65B 1/36; B65B 43/26

[52] U.S. Cl. ..... 53/452; 53/572; 53/384

[58] Field of Search ..... 53/29, 189, 190, 384, 53/385, 386

[56] References Cited

U.S. PATENT DOCUMENTS

| | | | |
|---|---|---|---|
| 762,275 | 6/1904 | Bowden | 53/189 |
| 1,600,320 | 9/1926 | Danquigney | 53/385 X |
| 2,340,225 | 1/1944 | Nowak | 53/190 X |
| 3,789,570 | 2/1974 | Mullins | 53/29 |
| 3,807,122 | 4/1974 | Kihnke et al. | 53/385 X |

*Primary Examiner*—Robert Louis Spruill

*Attorney, Agent, or Firm*—Wofford, Felsman, Fails and Zobal

[57] ABSTRACT

Method and apparatus for automatically bagging material, such as ice, characterized by a carrier that is reciprocal between a rearward position where a measuring cavity is filled and a forward discharge position for discharging into an opened bag; a supply of flattened plastic bags below the carrier; means for pulling forwardly and upwardly simultaneously adjacent both edges of the forwardmost bag to facilitate filling; and appropriate drives and a plurality of cam and cam followers to effect reciprocation of the carrier and filling of the bags. After the bag is full it is released into a filled bag compartment; for example, responsive to a coin operated device. Desirably, after the bag has been filled, it is sealed so as to prevent spilling of the material. The forwardmost bag is separated completely. Difficulties with the prior art obviated.

8 Claims, 15 Drawing Figures

Fig. 1
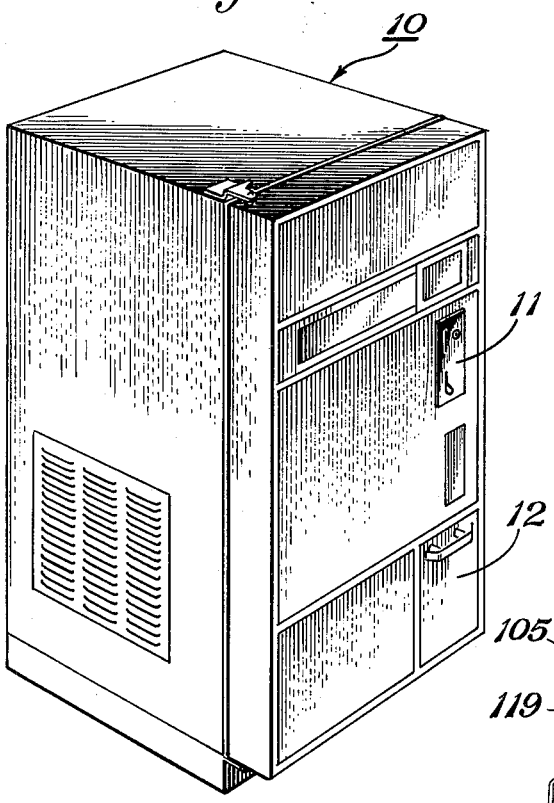
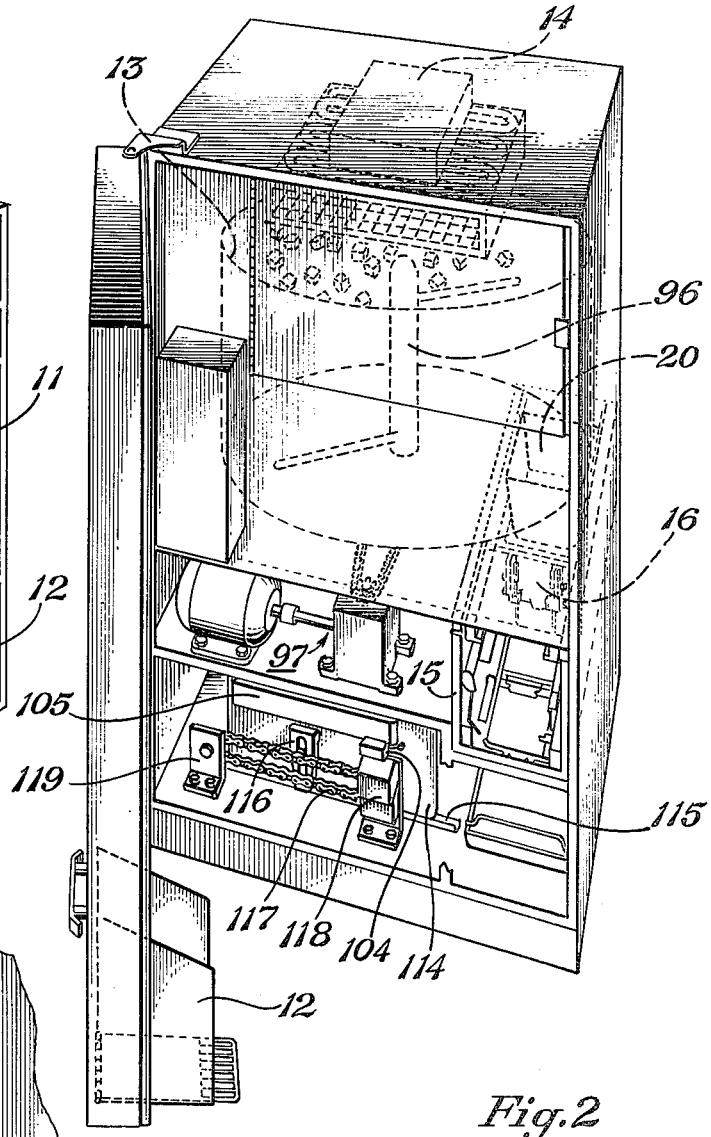
Fig. 2
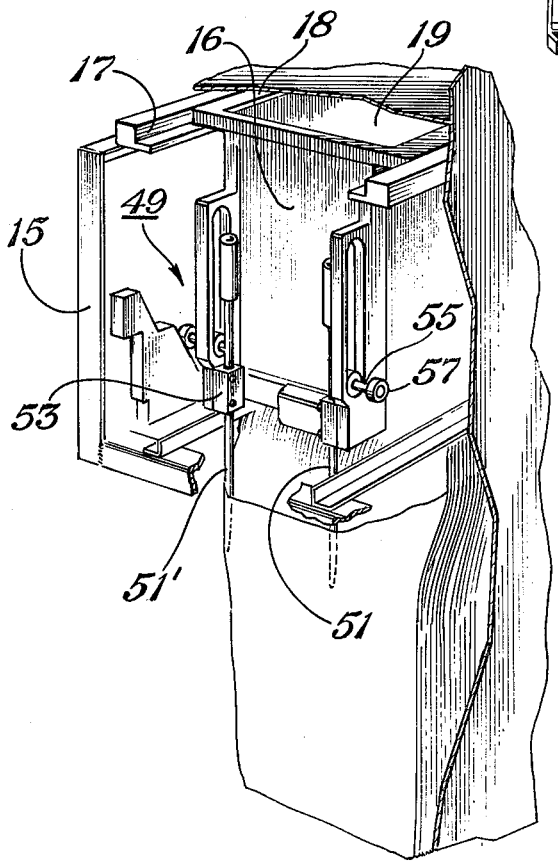
Fig. 3

METHOD AND APPARATUS FOR BAGGING MATERIAL

BACKGROUND OF THE INVENTION

1. Field of the Invention

This invention relates to method and apparatus for sequentially opening respective ones of a plurality of plastic bags and filling the plastic bags. In one of the preferred embodiments, this invention relates particularly to apparatus that is adapted for use with coin operated machines for automatically filling bags with material such as ice cubes that have been frozen in the apparatus.

2. Description of the Prior Art

The prior art has seen the development of a wide variety of methods and apparatuses for filling a bag with material. One area that has been particularly troublesome has been the dispensing of small quantities (a few pounds) of ice cubes at locations, such as in motels. Ordinarily, an ice making machine will freeze the cubes and dump them into a storage bin. Thereafter, the consumer scoops the cubes from the bin into his own container. This type of dispensing has resulted in very unsanitary conditions at times. In fact, several states and governmental agencies have banned this because of the unsanitary conditions and transmission of diseases that have occured. For example, if the bin is not cleaned periodically, slime may gather on its walls. Also, consumers may use their hands or the like and transmit diseases. Also, consumers will sometimes temporarily store items such as fish, milk, and the like and even attempt to chill melons or other fruits in the bins.

In order to try to obviate these unsanitary conditions, plastic bags filled with ice cubes have been stored in publicly accessible places. While this may tend to solve the sanitation problem it increases the costs as it involves considerable manual labor. The closest prior art that is known is U.S. Pat. No. 3,789,570, entitled "Bagging Apparatus and Method" issued Feb. 5, 1974 to James N. Mullins, Jr.; and the descriptive matter of that patent is incorporated by reference herein for details that are omitted herefrom. That patent discussed the fact that attempts have been made to develop machines that would freeze and automatically bag ice cubes at the point of consumption; for example, at a motel. As pointed out therein, the machines before that patent have not been successful for various reasons, one of the primary reasons being the difficulty of handling plastic bags that are extremely flexible and not self supporting when not opened as is a Kraft bag or the like. The method and apparatus delineated in that patent provided one way of solving this problem and that invention has been commercially successful. Success has created an expanding market that now includes, in addition to motels, grocery stores, airlines and associated facilities. It is impossible to have trained servicemen at all facilities. During the expanding use of the machines, however, it has been found desirable to provide method and apparatus that had one or more of the following features not heretofore provided.

1. It is desirable to pull on the plastic bag at a plurality of points adjacent the outside edges of the forward side so as to pull it open and pull the bag; particularly the bottom; away from the next succeeding bag; instead of pulling on one point alone with only one rod and having less satisfactory opening and more failures.

2. It is desirable to simplify the settings of cams, cam followers, linkages and the like such that field operators can more easily repair or correct difficulties with the apparatus. In fact, it is desirable to make one adjustment and setting at the factory and eliminate the necessity for field adjustments.

3. It is desirable to minimize difficulties with providing a proper squeeze on grasping buttons for holding the front edge of the bag.

4. It is desirable to alleviate problems with tricky door cams on the right hand side that affected the insertion, grasping, holding, release and withdrawal of the grasping buttons.

5. It is desirable to provide a structure that alleviates problems with the buildup of accumulation of snow when the ice is soft and frozen fast, as in winter operations. The prior art structure required the trapdoor hinge to be mounted internally of the measuring cabinet and had such problems.

Thus, it can be seen that the prior art, even the improved art represented by U.S. Pat. No. 3,789,570, was not totally satisfactory in providing apparatus for automatically filling bags with material stored in bulk, as ice cubes from an ice bin.

SUMMARY OF THE INVENTION

Accordingly, it is an object of this invention to provide method and apparatus that effects or has one or more of the features delineated hereinbefore as being desirable and not heretofore provided by the prior art.

Specifically, it is an object of this invention to provide method and apparatus that effects or has a plurality of the features delineated hereinbefore and not heretofore provided by the prior art.

It is an object of this invention to provide method and apparatus that obviates the disadvantages of the prior art; that provides all of the advantages provided by the improved method and apparatus of U.S. Pat. No. 3,789,570, and also provides all of the features delineated hereinbefore as being desirable and not heretofore provided.

These and other objects will become apparent from the descriptive matter hereinafter, particularly when taken in conjunction with the appended drawings.

In accordance with this invention, there is provided a method of opening and filling a flexible plastic bag from a series of such bags having openable ends and being of the type that have a portion of their rearward side extending above their forward side. The method is characterized by a plurality of steps. The bags are supported at their rearward sides while at the same time causing the foremost bag to have its extending portion inclined rearwardly and upwardly of the remainder of the bag to provide an inclined surface while the upper edge of the forward side of the bag remains in close proximity to the rearward side of the bag. The forward side of the bag is then opened by pulling simultaneously on both edges of the forward side of the bag so as to pull it away from the rearward side and then the forward side of the bag is moved upwardly and forwardly to open the bag further and pull its bottom away from the next bag while continuing support of the rearward side of the bag. The material is deposited into the bag. The bag is preferably sealed. The bag with the material therewithin is then cleared, either of its own weight or by the consumer pulling it out of the apparatus.

In another embodiment of this invention, there is provided apparatus for successively opening a plurality of flexible plastic bags and for holding them open while material is deposited therewithin, the bags being of the type delineated in the preceding paragraph. The apparatus comprises a support; a carrier mounted for horizontal reciprocation on the support; means for supporting a plurality of the flattened bags of the aforesaid type beneath the carrier so that the forward bag has an extended portion upwardly and rearwardly of the remainder of the bag. The apparatus includes a bag opening means for pulling forwardly and upwardly simultaneously on both edges of the forward side of the bag adjacent the respective edges of the carrier and of the bag so as to pull the bottom of the bag away from the next succeeding bag to facilitate filling. Actuating means is provided for the bag opening means and includes a mounting means for moving the lower end of the bag opening means downwardly into sliding contact with the inclined portion of the bag and thence along the portion downwardly into the interior of the bag to move the forward side thereof away from the rearward side to partially open the bag and to move it to a more fully opened position. Means is provided for retracting the bag opening means from the bag responsive to and coordinated with reciprocal movement of the carrier such that the bag is moved beneath the discharge portion of the carrier for filling and can be closed upon the return stroke of the carrier after having discharged the material into the bag.

In respective aspects, the apparatus enables particularly beneficial construction in allowing the hinge for the trapdoor on the carrier to be mounted forwardly of the interior of the measuring cavity so as to obviate difficulties with the snow or soft ice piling up interiorly of the measuring cavity; the use of two elements that have a vertical component of movement so as to move each side of the bags forwardly and upwardly for more nearly completely opening the bag and pulling the bottom away to clear a door, yet obviating difficulties with difficultly adjustable and difficultly teachable settings on apparatus such as gripping buttons, cam surfaces, cam followers and the like.

BRIEF DESCRIPTION OF THE DRAWINGS

FIG. 1 is a perspective view of a coin operated machine for automatically freezing and bagging ice cubes, which internally contains a preferred embodiment of the apparatus of this invention and which enables carrying out the method of this invention.

FIG. 2 is a view with the front door of the apparatus of FIG. 1 in an open position and showing a portion of the apparatus at an intermediate point in a bag filling cycle.

FIG. 3 is a partial perspective view of the front end of the carrier and bag opening means illustrating the pulling the forward side of the bag forwardly to more fully open the bag to facilitate filling.

DESCRIPTION OF THE PREFERRED EMBODIMENT(S)

Herein, this invention will be described with respect to a coin operated ice dispensing machine. It should be borne in mind, however, that this invention can be employed in any method and apparatus in which material is to be transferred from relatively large bulk storage into smaller bags, or packages, for being dispensed.

Figure 12:
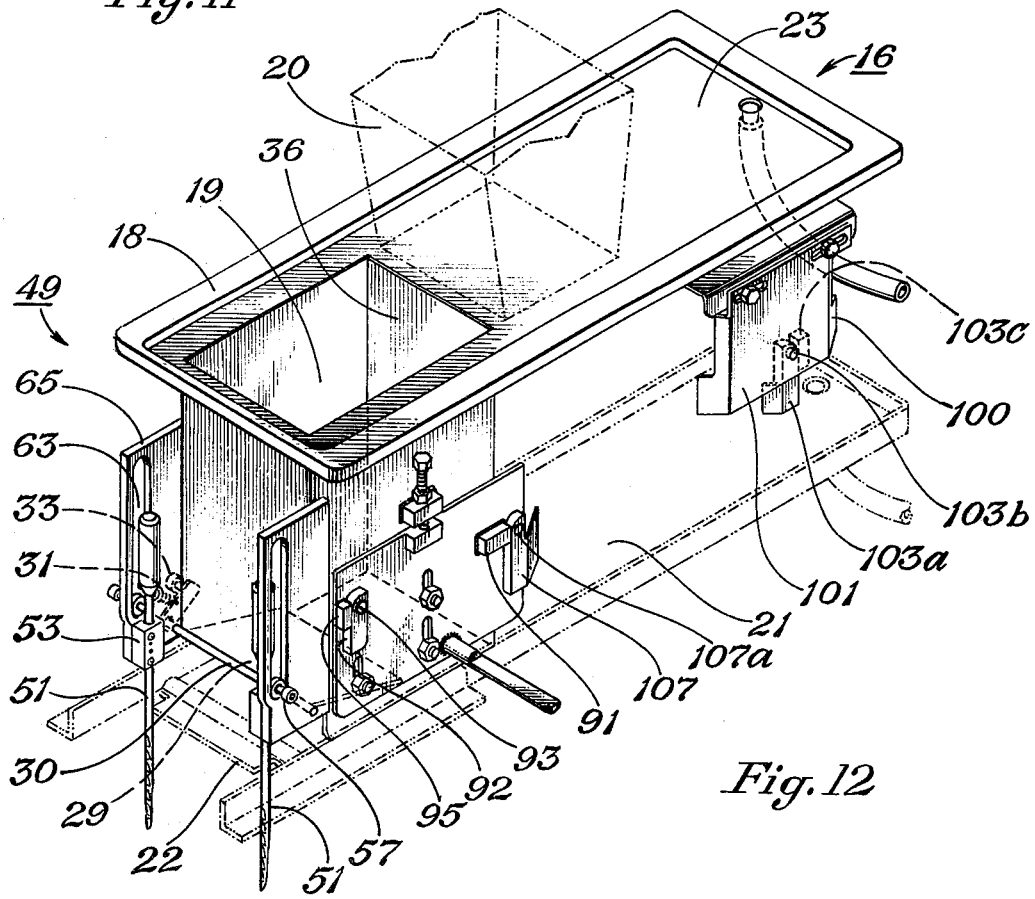
FIG. 12 is a perspective view of the bagging and metering mechanism.

Referring to the drawings and in particular to FIG. 1, the cabinet 10 is provided with conventional coin operated switch mechanisms 11 and an access door 12. As illustrated in FIG. 2, the upper part of the cabinet 10 contains an ice cube bin 13 into which ice cubes are deposited by a conventional freezing unit 14. The latter is of the type that freezes a layer of ice on the under side of a refrigerated plate and then defrosts the plate to permit the ice layer to drop upon and through conventional hot wire cube cutters. A frame 15 is disposed beneath the ice bin and supports a carrier 16, FIG. 3, for reciprocal movement within the cabinet. The frame 15 serves as a support and includes guide members 17 that slidably carry edges of an upper plate 18 of the carrier 16. The carrier 16 has a metering, or measuring, cavity 19, FIGS. 3 and 12, therein. The cavity 19 has an open top and bottom that are otherwise closed or opened for respective receiving and discharging at the respective points in the cycle. Thus, when the carrier 16 is moved rearwardly, the cavity 19 comes into registry with the bin opening 20, FIGS. 4 and 12, so that ice cubes can fall into the cavity to fill it. At this point, the low end of the cavity is closed by a trapdoor 29 and plate 21 over which the carrier 16 moves. The plate 21 terminates at a point 22, FIG. 12, so that the ice can be discharged from the cavity 19 upon the forward movement of the carrier 16 a sufficient distance, as explained in more detail hereinafter. The carrier 16 is provided with a rearwardly extending portion 23 that acts to close the bin opening 20 at all times during the operation of the equipment except when the cavity 19 is being filled.

Figure 6:
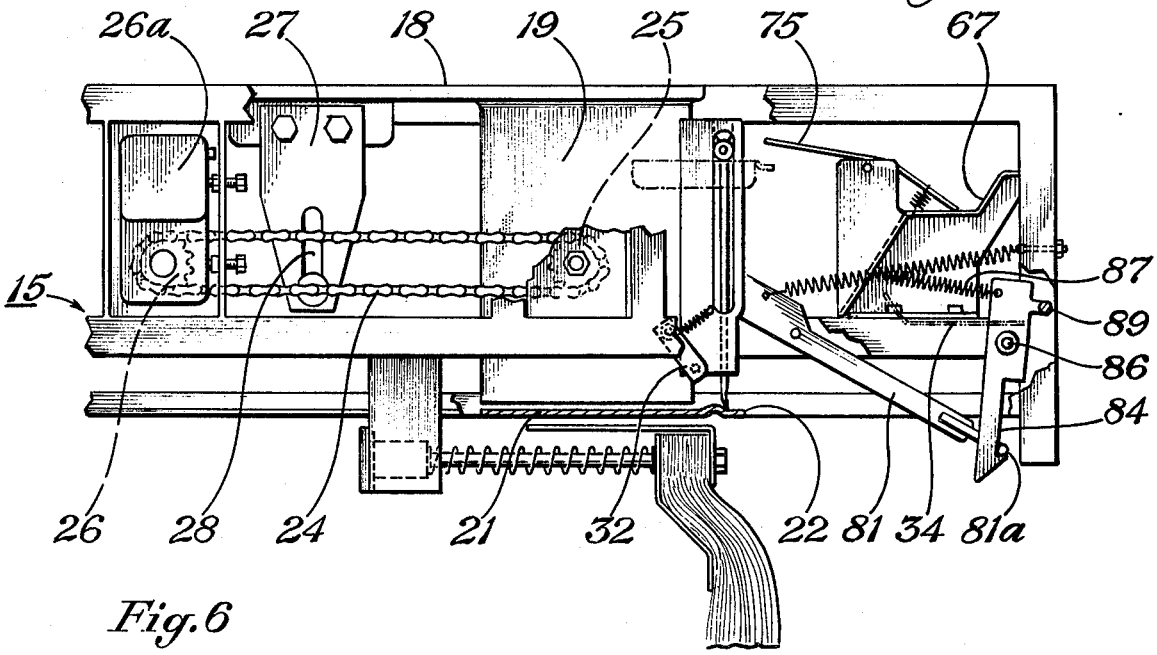
FIG. 6 is an elevational view of the metering and bagging mechanism from the left hand side with the mechanism being positioned at the end (or start) of a cycle.

Means are provided for reciprocating the carrier 16 through a cycle of operation. Referring to FIG. 6, this means is illustrated as including an endless sprocket chain 24 extending between an idler sprocket 25 and a motor driven sprocket 26, all of which are mounted on frame 15. The carrier 16 has a driven flange 27 connected thereto which has an elongated opening 28 through which a pin extends, the other end of the pin being connected to the chain 24. Thus, upon actuation of the motor driven sprocket 26 the carrier will move rearwardly by the pin when the latter is in the bottom of opening 28 and as the pin moves around the motor driven sprocket 26, it will move upwardly in opening 28 to be in an upper portion thereof as the carrier is moved forwardly. Similarly, the pin will move downwardly in opening 28 as it moves over the idler sprocket 25.

Figure 7:
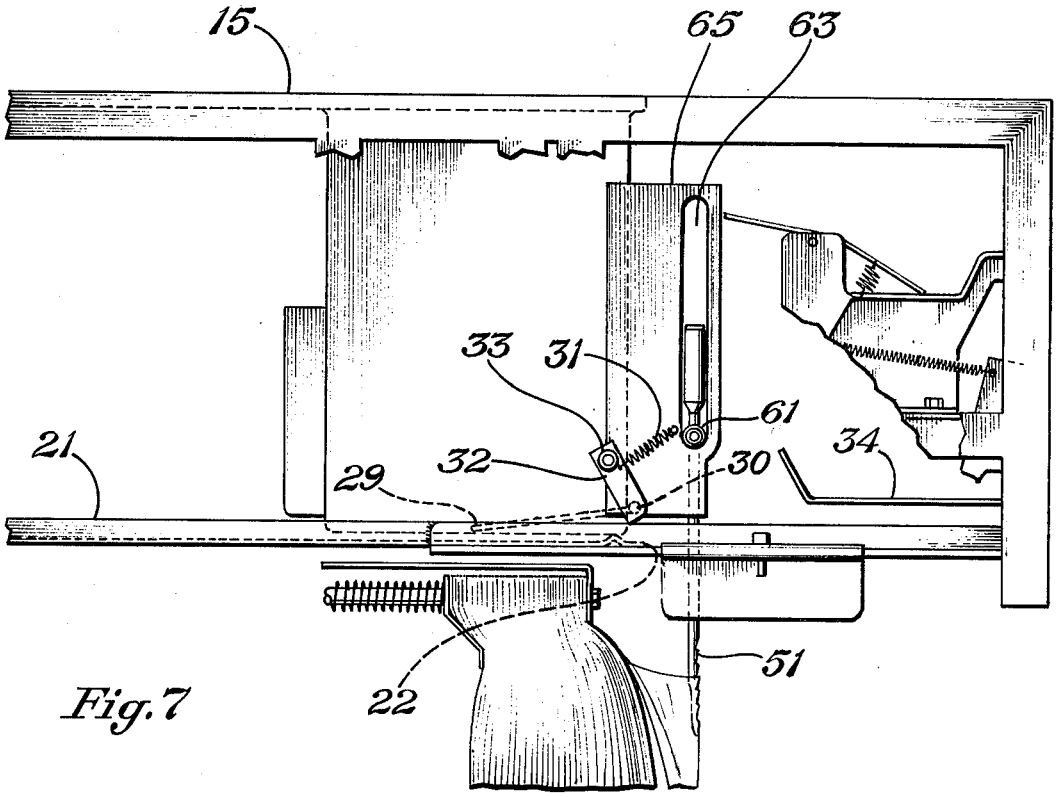
FIG. 7 is a side elevational view similar to FIG. 6 but with part of the supporting framework broken away and showing the mechanism during the initial part of the bag opening cycle.
Figure 8:
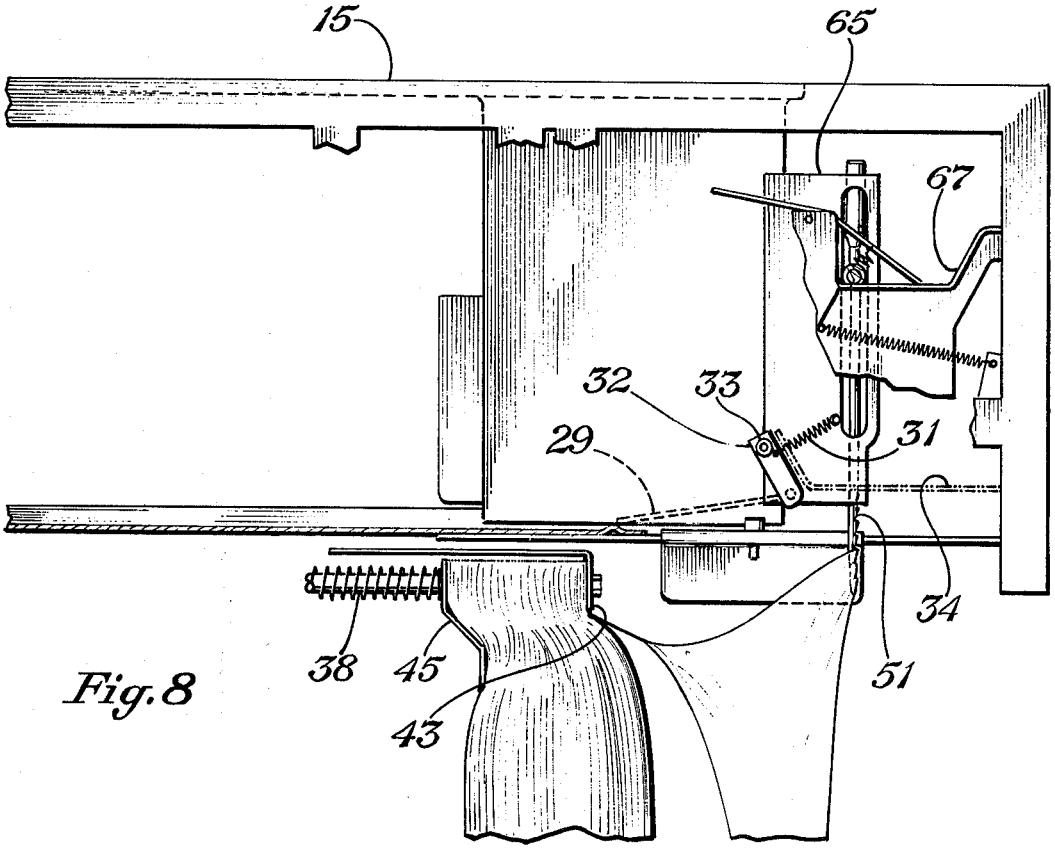
FIG. 8 is a view similar to FIG. 7 but showing the mechanism in a subsequent portion of the bag opening cycle.
Figure 10:
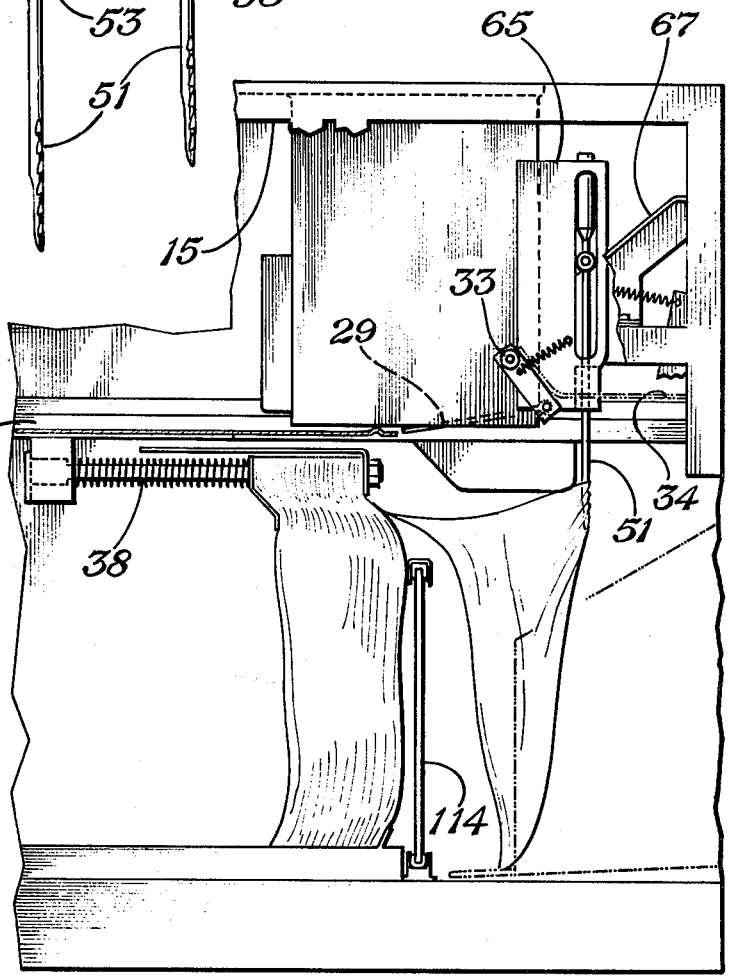
FIG. 10 is a view similar to FIG. 8 showing the bag opening mechanism in still another more advanced portion of its cycle.

Referring to FIGS. 7, 8 and 10, a trapdoor 29 is provided adjacent the bottom of cavity 19. The trapdoor 29 is hingedly mounted on the front of the carrier 16 exteriorly of the cavity 19 so as to prevent build-up of soft ice or frost. Specifically, the trapdoor 29 is hingedly mounted by way of pivot pin 30 fixed to the trapdoor 29 and journalled in suitable brackets. The trapdoor 29 is urged toward a closed position by spring 31 acting on arm 32 that is connected to the pivot 30. The arm 32 carries a cam roller 33, also referred to as a cam follower, that engages the lower side of a ramp 34 to open the trapdoor 29 at an appropriate point during the cycle. The ramp 34 may be affixed by any suitable means, as by welding. Thus, as the carrier 16 moves rearwardly and receives ice cubes in its cavity 19, the weight of the cubes will normally press the trapdoor 29 downwardly so that it rides along the surface of the bottom plate 21 until the carrier moves forward sufficiently that the trapdoor clears the end 22 of the plate 21. At this point, the cam roller 33 engages the underside of ramp 34 to positively open the door 29 so that the contents of the cavity can be discharged into an open bag thereunder. As will be explained hereinafter, at the time the front end of the cavity 19 reaches the end 22 of plate 21, the bag thereunder has not been fully opened and it is desired to delay discharging the contents of the cavity until the bag has been substantially fully opened.

If desired, the trapdoor 29 can be operated by a pair of arms 32 and cam rollers 33 on each of the respective sides so as to provide more nearly even torque and lessen the wear and tendency to bind. This has not been found to be necessary, however.

Figure 4:
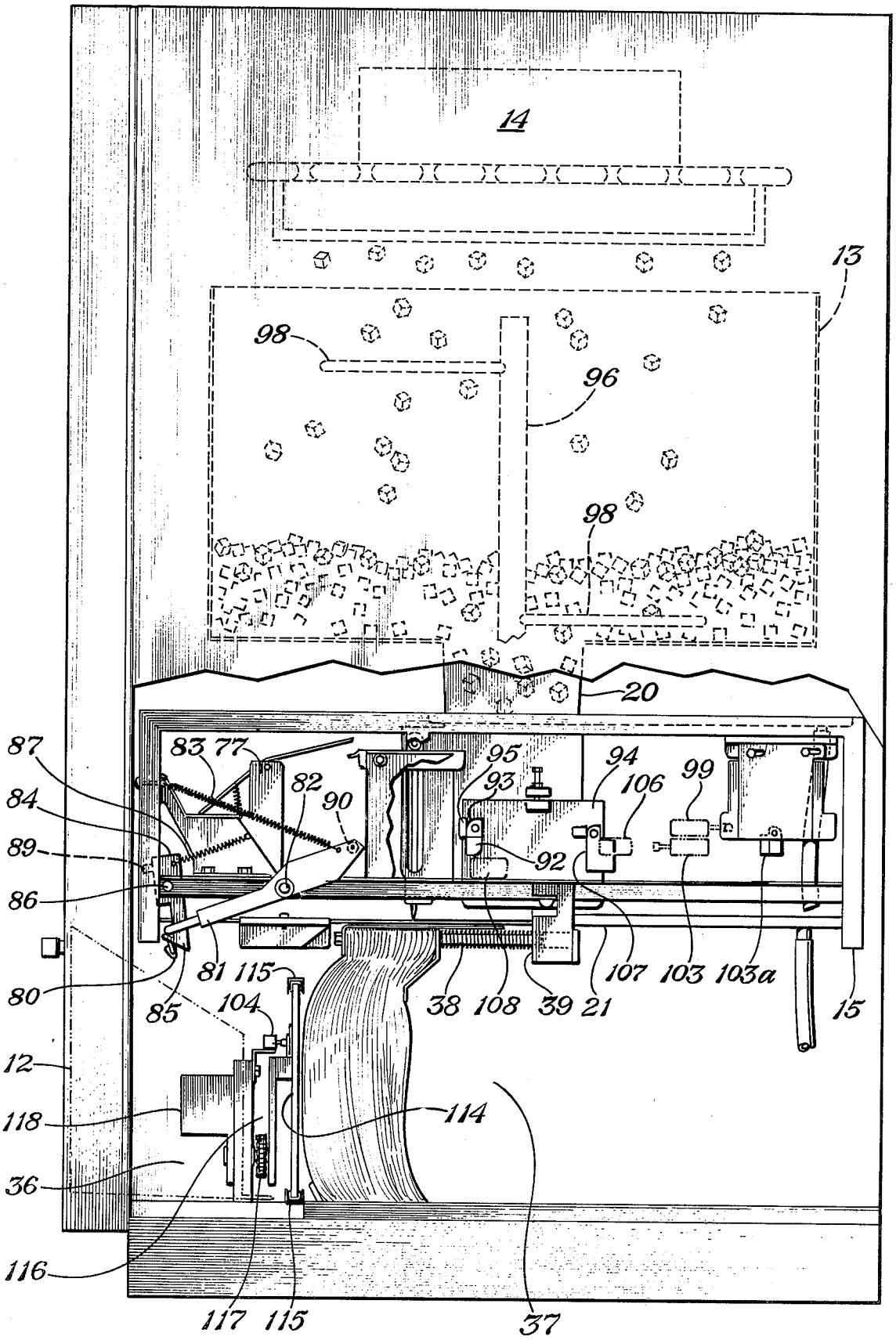
FIG. 4 is an elevational view, partly in phantom, showing metering and bagging mechanism from its right hand side as viewed from the front of the machine and in that position of its cycle in which ice cubes are passing from a bin into a metering cavity.
Figure 13:
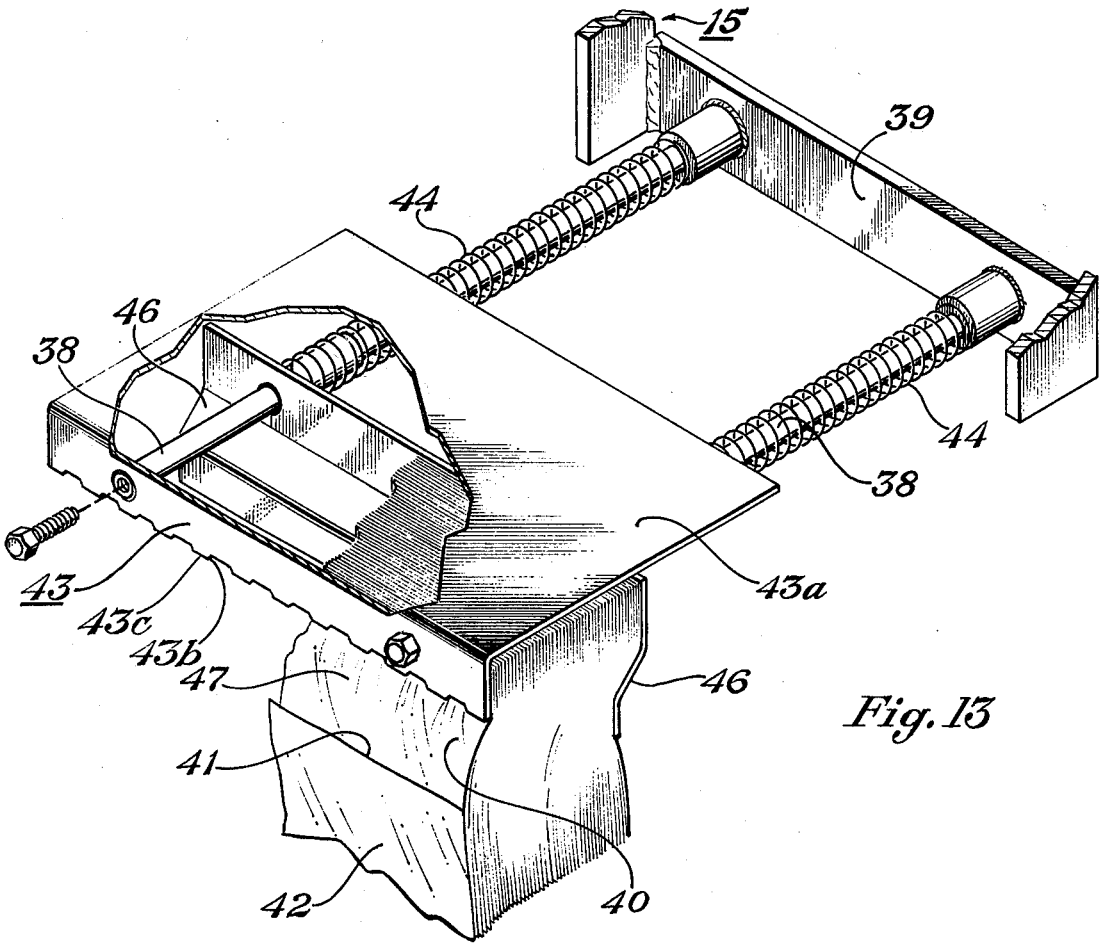
FIG. 13 is a perspective view showing the bags support arrangement.

Referring to FIG. 4, the cabinet or housing 10 is provided with a bag filling section 36 and a bag storage section 37. An opening is provided between the bag filling section 36 and the bag storage section 37 for passage of a bag from the storage section into the filling section. Means are provided in a storage section for supporting a plurality of flattened plastic bags. Referring to FIGS. 4 and 13, this means includes a pair of support rods 38 having their rear ends fixedly connected to the frame part 39 carried by frame part 15. The type of bags employed has a rearward side 40 extending above the upper edge 41 of the front side 42 of the bag. Holes are provided in the back side of the bag adjacent the upper edge so that a plurality of bags can be supported on rods 38. The bags are urged forwardly so that the foremost bag is in contact with a retainer plate, or stop, 43. The retainer plate 43 carries a top 43*a* to prevent water from dripping into the bags. The retainer plate 43 also has serrations 43*b* in order to form teeth 43*c* for more securely gripping the bags. The urging is by the action of spring 44 on a follower 45 that is slidably mounted on the rods 38 rearwardly of the bags. The follower 45 has a forwardly inclined portion 46 near its lower end. The forwardly inclined portion 46 causes the rearward side of the bag to have a rearwardly and upwardly inclined portion 47 exposed above the upper edge 41 of the front side, or forward side, 42 of the bag.

Figure 5:
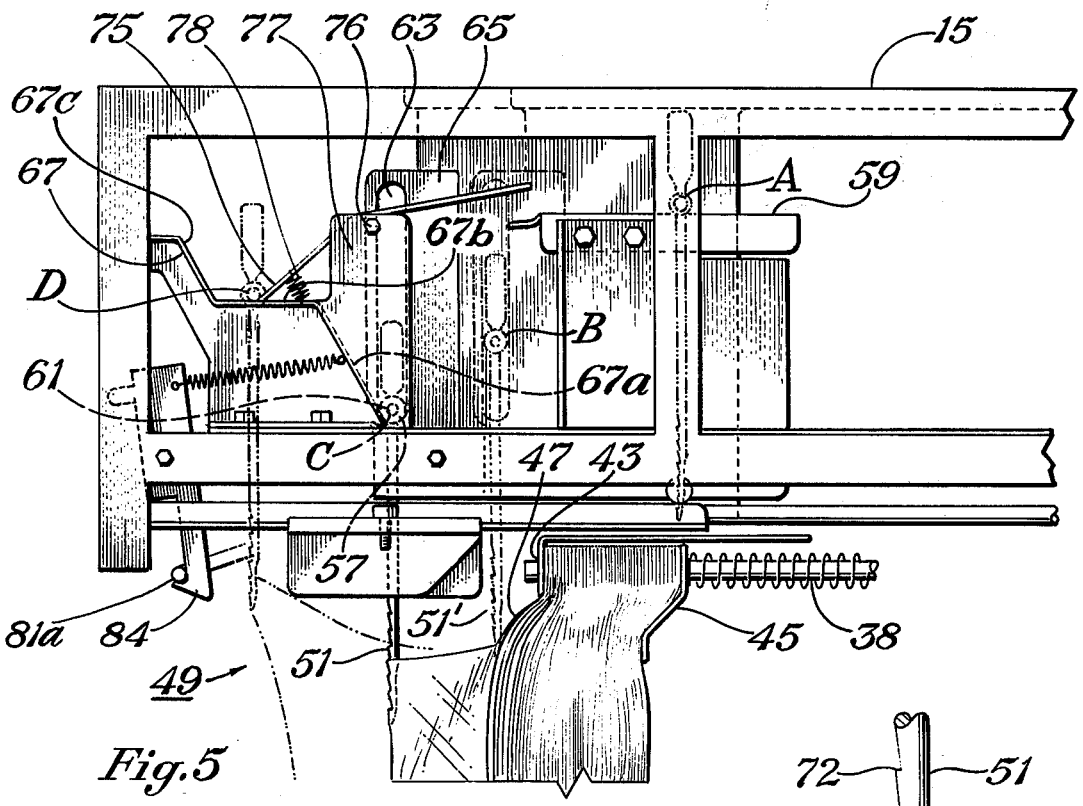
FIG. 5 is a view from the right hand side showing the operations of the bag opening elements used to initially open a bag.

A bag opening means 49, FIG. 5, is provided for pulling forwardly and upwardly simultaneously on both edges of the forward side of the bag so as to pull it, particularly its bottom, away from the next succeeding bag to facilitate filling. As illustrated, the bag opening means comprises a plurality of bag opening elements, or rods, 51 carried by the forward end of the carrier 16.

Figure 5A:
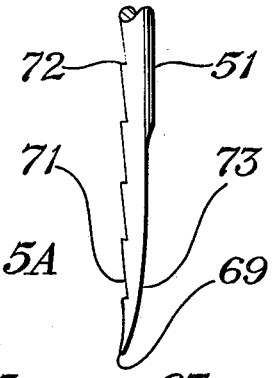
FIG. 5*a* is an enlarged side view of the lower end of a bag opening element.
Figure 9:
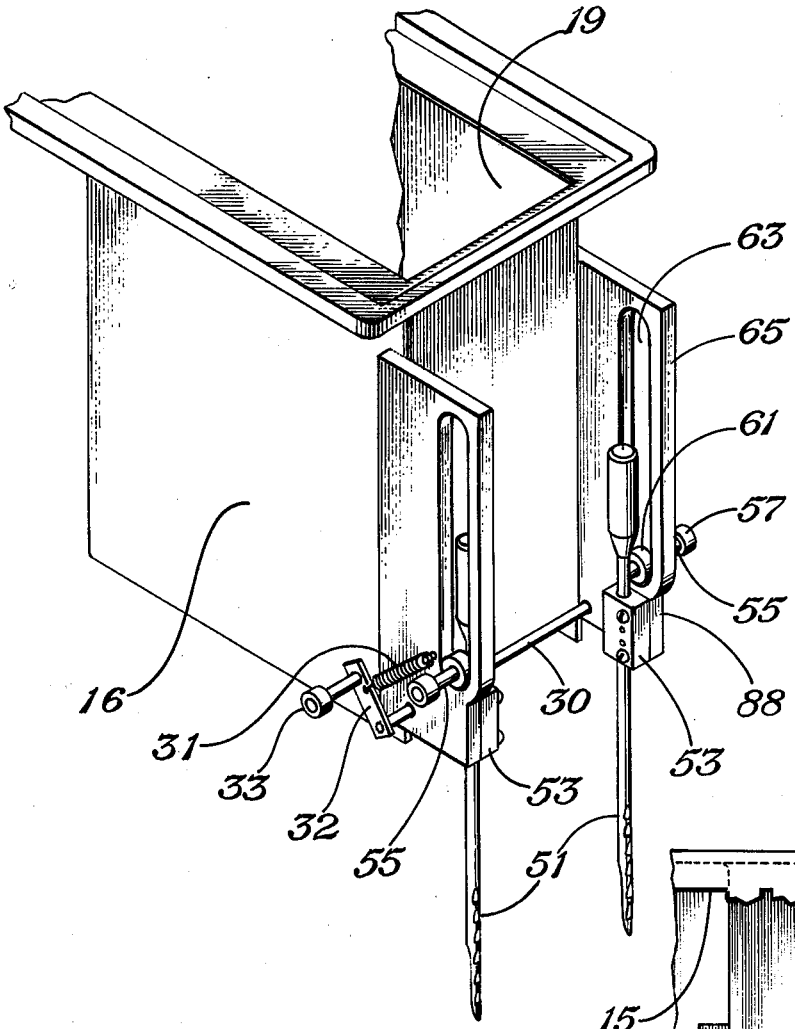
FIG. 9 is a perspective view to further illustrate the bag opening arrangement.

The reason for at least two such rods are as follows. Plastic bags vary greatly in response from batch to batch and day to day. In some countries the types of bags are different, and the government requires buying nationally manufactured bags. Moreover, bags picked up static electricity in shipment and movement and the electrostatic charge varied the response. The relative humidity affected the response of the bags. Ambient temperature affected the response of the bags. With a single rod, the apparatus did not afford positive control over the varied responses and bag opening was undependable. Sometimes the single rod apparatus opened only one side or pulled only one bottom corner free; other times failing to free statically charged bags thereby causing them to be hit and trapped by the sealing door in its closing. Consequently, more positive control was found necessary to obtain a forced uniform response. The use of at least two bag opening elements afforded this more positive control, yet simplified the apparatus, adjustments and the like, as noted herein. Particularly, the use of the two bag opening elements with the structure described hereinafter gave sufficiently positive control to satisfactorily handle the bags under any condition, regardless of temperature, humidity, static charge or batch of bags. This more positive control is necessitated, since the machines are now being placed in areas as diverse as the hot, dry, high static electrical deserts of the Middle East and the humid conditions of London. Specifically, the respective bag opening elements are mirror images of each other and are positioned on the right and left sides of the forward end of the carrier 16, as illustrated in FIG. 3. As illustrated in FIG. 5, each bag opening element 51 has a relatively thin lower end that can be positioned on the inclined bag portion 47, as illustrated by the dashed outline 51'. As the carrier 16 is moved forwardly, each of the elements 51 move forwardly while riding along this inclined portion to drop downwardly into the interior of the front bag between the front and rear sides thereof to initiate opening of the bag, as shown in the full line view in FIGS. 3 and 5. Referring to FIGS. 3 and 9, each bag opening element, or rod, 51 is mounted on carrier 16 for vertical movement by sliding in a sleeve 53. Each element has an arm 55 bearing a cam roller 57 for following along a series of camming surfaces similarly as illustrated in FIG. 5. Thus, during the initial portion of a cycle, the cam roller 57 will rest upon a support 59 fixed to the frame 15, as at position A, to hold the rod in its uppermost position during reciprocal movement of the carrier horizontally. As the carrier 16 moves forward, the cam roller 57 will move to the end of the support 59 and drop off the support to position B. At position B, the lower end of the element 51 is in sliding contact with the inclined bag portion 47. As the carrier 16 continues its forward movement, the element 51 will move downwardly on this inclined portion in the bag until a bearing 61, FIG. 9, on arm 55 rests in the bottom of an opening 63 in flange 65. The flange 65 is attached to the carrier 16. Continued forward, or outward, movement of the element 51 will pull the front side of the bag forwardly to tension the forward side and open the bag. When the cam roller 57 has been advanced to position C, FIG. 5, it will engage and begin to move upwardly along a ramp, or lifting cam, 67 and pull the front side of the bag forwardly and upwardly to open the bag and pull the bottom of the bag away from the next succeeding bag to clear a path for a door and to facilitate loading. The ramp, or lifting cams, 67 may be affixed by any means, such as welding. As illustrated the ramp 67 has the ramp 34 welded to it and is welded onto the support or framework of cabinet 10. In order to enable the respective elements to pull the forward side of the bag forwardly and upwardly satisfactorily, each of the elements should penetrate into the bag for a considerable distance; for example, ten percent of the height of the bag or two inches. Moreover, best results are obtained when the lower end of the element 51 has a specific shape to facilitate this pulling forwardly and upwardly on the front side of the bag to be filled. As illustrated in FIG. 5*a*, the lower end of the element 51 has a pointed end 69 with serrations, or notches, 71, formed in its forward side above the lower end. The edges 72 of these notches 71 frictionally engage the surface of the forward side of the bag as the rod moves forwardly and upwardly to raise the outer side of the bag some degree for the purpose described herein. Any other means of increasing the frictional force with which the bag opening elements 51 engage the forward side of the bag can be employed, as long as it does not adversely restrict downward movement, or fall, of the elements 51. For example, physical or chemical roughening of the forward edges of the elements 51 could be employed. Without the notches, or friction increasing means, the bag forward side tends to slip and cause improper opening. The backside of the lower end has an arcuate or inclined portion 73 to facilitate sliding downwardly along the upwardly inclined portion 47 of the bag. The use of the plurality of elements 51 has obviated the requirements for additional bag support means, including the difficultly adjustable camming and tensioning means for being lowered into and gripping the bag.

As the carrier 16 moves on forwardly and the cam roller 57 moves upwardly along the ramp 67. Each of the side ramps 67 is divided into three segments — a lower inclined portion 67*a*, a substantially horizontal portion 67*b*, and an upper inclined portion 67*c*. The lower inclined portions 67*a* cause the bag opening elements 51 to pull the bag up and out for receiving the material as the carrier 16 moves forwardly and the cam rollers 57 move forwardly and upwardly along the lower inclined portion 67*a*. As the carrier 16 moves forwardly and cam roller 57 moves forwardly along the horizontal portion 67*b*, the trapdoor is opened, as described hereinbefore, and the material is dropped into the open bag. As the carrier 16 moves forwardly, moving the element 51 and cam roller 57 to position D, the roller lifts tilting ramp 75, and passes, allowing the end of the ramp to drop back onto the horizontal portion 67*b* for trapping the cam roller 57 on its return. The cam roller 57 is carried by the carrier 16 forwardly and is moved upwardly along the upper inclined portion 67*c* to pull the element 51 upwardly out of the path of the heating rod lever 81 carrying heating rod 81*a*. This allows the heating rod 81*a* to be freed and moved downwardly for sealing the bag that has been filled with the material, such as ice cubes.

As the cam roller 57 is moved rearwardly, it rolls downwardly along the upper inclined portion 67*c* to horizontal portion 67*b*. There it engages the tilting ramp 75. The tilting ramp 75 is pivoted at fulcrum shaft 76 that is carried by support 77. The support 77 extends upwardly and is attached to the outer edge of ramp 67. If desired of course, the ramp surfaces may be formed directly from solid bar stock or the like. The outer end of the ramp 75 is resiliently urged into engagment with the ramp 67 by a spring 78. The cam roller 57 will roll up the upper side of the tilt ramp 75; and, as it moves to the rear end of the ramp, the weight of the rod, or element 51, will cause the tilt ramp to again tilt until its rear end engages the forward end of the support 59 so that the cam roller can move to again be positioned on the support 59 at position A. Thus, it will be seen that the bag opening elements 51 are provided with respective actuating means including means mounting the element for reciprocal motion for movement to move the lower end of the element downwardly into sliding contact with the inclined portion of the rearward wall of the foremost bag and, thence, along the portion down into the interior of the bag; after which it is moved forwardly and upwardly to move the forward side of the bag forwardly and upwardly away from the rear side to open the bag for filling; and to withdraw from the bag after it has been filled and allow the bag to be closed.

With an untended coin operated machine it is desirable to protect the bags and the bag filling section 36 (FIG. 4) from pilferage by someone opening access door 12 to reach a bag of ice and then reaching back and removing the bags from the storage section. To prevent this, and also to cooperate with a heat sealing means for sealing a bag, a closure means here illustrated as sliding door 114 is mounted for movement in tracks 115 between opened and closed positions with respect to the opening between the bag filling and bag storing sections. Means are provided for automatically causing such movement. Specifically, the door is provided with a drive flange 116 which is connected to a drive sprocket chain 117 in the same manner as drive chain 24 is connected to drive flange 27 for the carrier. When the motor 118 is turned on it will cause the chain to turn on idler sprockets mounted on brackets 119 (FIG. 2) to move the door to open position as shown in FIG. 2. After the mechanism described hereinbefore has moved a bag into the bag filling compartment, operation of the motor 118 will cause the door to move to close the opening between the bag filling section and the bag storage section as shown in FIG. 4. To facilitate this, tracks 115 terminate near the left edge, as viewed in FIG. 2, of the opening and the door is of such height that it can be moved to the closed position while the bag being filled can continue to be supported on rods 38 when the door is in a closed position, shown in FIG. 10.

In order to permit the door to slide between the bag and the bag filling section and the bags remaining in the bag storage section, it is necessary that the lower end of the front most bag to be filled be moved away from the bags in the storage section a sufficient distance to clear the door. To achieve this function, the respective bag opening elements 51 are lifted by their cam followers, or cam rollers 57, and the edge of the notches on the lower end of each of the elements 51 will ensure moving the forward side of the bag upwardly as the rod is moved upwardly.

Heat sealing means are provided so as to be movable, responsive to movement of the carrier, to close the upper end of the bag and to apply heat thereto to heat seal the bag. This is illustrated as including a conventional bar type sealer 80 (FIG. 4) carried by a pair of levers 81, each of which is pivoted to the frame by a pivot 82. Only the right hand lever is shown, but it will be understood that a corresponding left hand lever is pivoted at the left hand side of the frame and that the outer ends of the levers are connected by a rod 81*a*, FIG. 6, and that the sealer bar can be connected to rod 81*a*. A spring 83 is connected to the right hand lever 81 and to the frame to urge the levers to move the sealer bar downwardly. However, a trigger lever 84 having a tip, or shoe, 85 at its lower end is pivoted at fulcrum shaft 86 to the frame and is urged to latching position by a spring 87 connected between the trigger lever and the ramp pivot support 77. The tip 85 has a notch to engage the rod 81*a* to retain the sealer mechanism in a cocked position as shown in FIG. 4.

Figure 11:
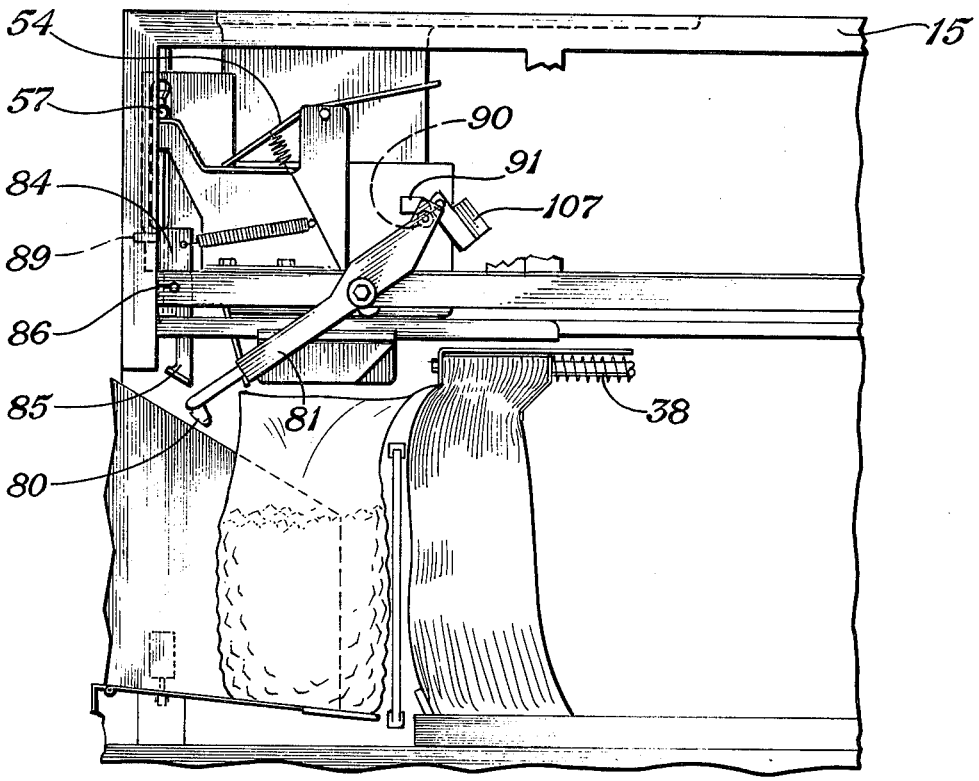
FIG. 11 is an elevational view of the mechanism from the right hand side showing the mechanism in a still more advanced stage of its cycle.

After the bag has been filled with the ice, the carrier will continue its forward movement until abutment 88 (FIG. 9) pushes against a bar 89 (FIGS. 6 and 11) fixed to and extending inwardly of trigger lever 84 to move the trigger lever to the unlatched position and release the bar-type sealer 80, as shown in FIG. 11. This permits the sealer mechanism to pivot downwardly until roller cam 90 on the inside of lever 81 strikes an abutment 91 on the carrier. As the carrier moves rearwardly, roller cam 91 will be disengaged from abutment 91 so that the sealer mechanism can then swing downwardly to move the forward side of the bag against the rear side and form a heat seal across the top of the bag.

As the carrier moves forward toward the bag filling position, the cam roller 90 on lever 81 will engage the lower end of toggle 92 (FIG. 4). The toggle 92 is pivoted at 93 to support 94 carried by the frame 15. Engagement with the cam roller 90 will cause the toggle to pivot upwardly so that the roller cam 90 can move therepast. However, as the carrier moves rearwardly toggle 92 will engage roller cam 90 to pivot the sealer bar upwardly. During the final portion of this movement, bar 89 will be freed to move rearwardly and the bar 81*a* will engage the underside of the shoe 85 to move the trigger lever 84 in a counter-clockwise direction (as viewed in FIG. 4) so that the bar can be moved to be engaged in its held position as illustrated in FIG. 4. Pivoting of the toggle 92 in a clockwise direction while it engages cam roller 90 to return the sealer mechanism to cocked position is prevented by a stop 95 carried by support 94.

As illustrated in FIGS. 2 and 4, the bin 13 is provided with an agitator in the form of an upstanding shaft 96. The shaft 96 is rotated by a motor and drive mechanism 97 (FIG. 2) and carries a pair of bars 98 (FIG. 4) that agitate the ice in the bin and prevent it from bridging. The agitator is operated only while the carrier is receiving ice from the bin and periodically during periods when ice is not being dispersed. A typical period may be from 7 to 9 seconds once each thirty minutes. Agitation during the ice dispensing cycle is controlled by agitator switch 99 (FIG. 4) carried by the frame 15 so that when the carrier moves rearwardly, the switch arm engages cam surface 100 (FIG. 12) to close the switch. The switch remains closed by virture of the switch arm riding along surface 101 while the carrier is moving rearwardly to place cavity 19 under bin outlet 20. Subsequently, as the carrier moves forwardly, the switch arm will open the switch to stop the agitation as soon as cam surface 100 moves forwardly of the switch arm.

OPERATION

In a method of operation, this invention comprises a series of steps. First, a plurality of flexible plastic bags having openable ends are suspended with their rearward sides extending above their forward sides to have the extending portion inclined rearwardly and upwardly of the remainder of the bag to provide an inclined surface while the upper edge of the forward side of the bag remains in close proximity to the rearward side of the bag. Second, the forward side of the bag is then pulled forwardly by simultaneously pulling both edges of the forward side of the bag away from the rearward side at a location adjacent the side extremities of the carrier to partially open the bag and then the forward side is moved forwardly and upwardly to open the bag further while continuing support of the rearward side; thereby pulling the bottom away from the next succeeding bag to allow room for a door to be moved into position behind the bag to be filled and to facilitate filling of the bag. Third, materials such as the ice cubes are deposited into the bag. Finally the bag is released so as to be delivered to the consumer. The simultaneously pulling forwardly and upwardly on both edges of the forward side of the bag is effected by placing a plurality of elements having respective thin ends in sliding contact with the inclined surfaces, sliding them downwardly therealong into the interior of the bag for an appreciable distance, retaining the forward side of the bag on the elements and then moving the elements forwardly and upwardly. This eliminates troublesome adjustments with cams, bag gripping tension of gripping buttons and the like, as well as expensive manufacturing and camming operating linkages.

Figure 14:
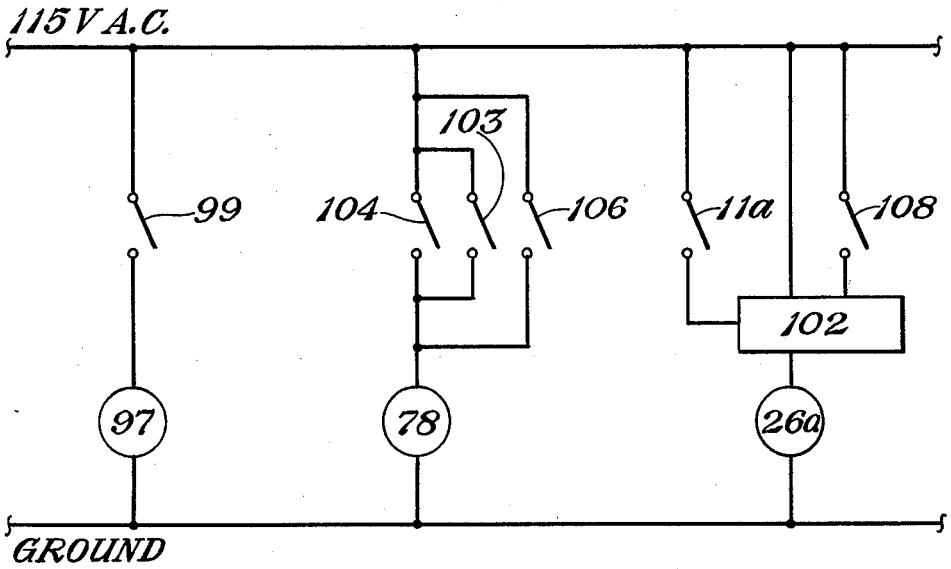
FIG. 14 is a schematic electrical diagram showing the mode of control of the apparatus.

The operation can be understood more nearly completely by referring to the detailed operation of the apparatus as follows. In the illustrated embodiment, a coin is deposited in coin operated switch mechanism 11 and this momentarily closes coin switch 11*a* (FIG. 14). The resulting pulse actuates double acting latching relay 102 which connects carrier drive motor 26*a* into the circuit. The drive motor 26*a* acts to start the carrier moving rearwardly until cavity 19 is below bin opening 20 so that ice cubes can fill the cavity. The backward movement causes agitator switch 99 to close, starting the agitating mechanism. As the carrier drive motor starts to move the carrier forwardly, switch 99 will be opened and agitation will cease. At about the same time, switch 103 (FIGS. 4 and 14) is closed momentarily by toggle 103*a* (FIG. 12), energizing door motor 118. As the door begins to open, a roller switch 104 on top of motor 118 is engaged and closed by platen 105 on door 114 and this maintains motor 118 in operation until the door is fully opened. Thereafter, the roller switch is opened by the platen moving out of contact with it. In the meantime, toggle 103*a* has moved past switch 103 permitting it to open. As the carrier moves forward, elements 51 drop down and begin to open the bag as shown at 51' in FIGS. 3 and 5. Further movement of the carrier 16 pulls the elements 51 forwardly and upwardly to pull the front side of the bag upwardly, resulting in movement of the bottom of the bag away from the other bags as shown in FIG. 10. As soon as the bag is pulled away, toggle 103*a* moves into engagement with the door closing switch 106 (FIG. 4) to effect closure of the door. This starts door motor 118 to begin running to move the door to its closed position with roller switch 104 again being held closed by engagment with platen 105 until the door has fully closed. After full closure, the switch will open and stop the door motor 118. Next, as the carrier moves forward, cam roller 33 will engage ramp 34 (FIG. 10) to move the trapdoor 29 to open position, thereby permitting the ice cubes in the cavity to fall into the bag. Next, cam roller 57 will have moved the bag opening elements 51 upwardly to slip out of the top of the bag that has been filled with the ice cubes, leaving the forward edge of the bag unsupported. During the last increment of forward movement, the carrier unlatches trigger lever 84 permitting the sealer bar 81*a* carrying the bar-type sealer 80 to move downwardly to the position illustrated in FIG. 11. Then as the carrier begins to move rearwardly, abutment 91 will clear cam roller 90 to permit the heater bar to swing all the way down, close the bag and form the heat seal. Thereafter, the roller cam 90 engages the toggle 92 to move the sealer bar back to the latched position, as described hereinbefore. During the final increment of movement in the cycle, toggle 107 (FIG. 4) engages switch 108, FIG. 14 to close it, causing latching relay 102 to open the circuit to the carrier drive motor 26*a*.

It will be appreciated that toggle 103*a* is pivoted to the carrier at 103*b* (FIG. 12) so that as the carrier moves rearwardly the toggle can swing upwardly when it engages door switches 103 and 106 so as not to actuate them. However, when the carrier moves forward, stop 103*c* prevents the toggle from swinging and the switches are actuated. Similarly, toggle 107 is pivoted at 107*a* so that it can be pivoted upwardly to avoid actuating stop switch 108 as the carrier moves forwardly but will actuate it when the carrier moves rearwardly.

From the foregoing, it can be seen that this invention provides all of the features and objects hereinbefore set out and alleviates the deficiencies of the prior art. Particularly, this invention provides apparatus that can be set at the factory and obviate the need for future field adjustments that were difficult to teach on a widespread basis and that made remote diagnosis, as by telephone, difficult. Moreover, the apparatus, though taking years to develop, is simpler in manufacture; and effects improved results in pulling a bag open for filling, preventing soft ice build up, and the like.

Although the invention has been described with a certain degree of particularity, it is understood that the present disclosure is made only by way of example and that numerous changes in the details of construction and the combination and arrangement of parts may be resorted to without departing from the spirit and scope of the invention which is to adjudged by the appended claims.

What is claimed is:

1. A method of opening and filling a flexible plastic bag from a series of such bags having openable ends and being of the type that have a portion of their respective rearward sides extending above their forward sides, including the steps of: supporting the series of bags at their rearward sides while at the same time causing the foremost bag to have its extending portion inclined rearwardly and upwardly of the remainder of the bag to provide an inclined surface while the upper edge of the forward side of the bag remains in close proximity to the rearward side of the bag; the improvement comprising initially positively, simultaneously and equally pulling both edges of the forward side of the bag away from the rearward side to partially open the bag by placing a plurality of elements having respective thin bottom ends in sliding contact with said inclined surface and sliding them therealong into the interior of the bag, retaining the forward side of the bag thereon, and then moving said elements forwardly and upwardly and moving simultaneously and equally the forward side of the bag forwardly and upwardly to open the bag further and holding the bag opened only with said elements without requiring difficulty adjustable clamping mechanism; said bag being opened and held open in a controlled way in advance of a cavity having an aperture in its bottom for depositing a measured quantity of material within said bag when over the opened said bag, while continuing support of the side of the bag whereby the bag, including its lower end, is moved away from the next succeeding bag; moving along a bottom plate a cavity containing said material with a bottom aperture at least a rear portion of which is open such that said material will fall into said open bag first adjacent said rearward side to ensure fully operable opening of said bag; thereafter depositing said material from said cavity into said bag; and after depositing said material in said bag reversing and moving said elements to release said bag containing said material; and releasing and setting said bag containing said material in a predetermined position to facilitate further handling such as sealing and picking up by a consumer.

2. The method of claim 1 wherein said elements each comprise respective rods with thin lower ends that are movable reciprocally responsive to a cam follower so as to have a vertical component of movement for moving downwardly into the bag and for lifting the forward side of the bag upwardly and forwardly; a cam follower is connected with each said element; a plurality of respective cam surfaces are provided along each side of the carrier to effect the respective vertical reciprocal movements of said elements as said carrier is moved reciprocally horizontally and means is provided for moving said carrier reciprocally horizontally and means is provided for moving said carrier reciprocally for receiving said material and for discharging said material into said bag and a trapdoor is pivotally mounted exteriorly adjacent the forward side of said cavity to block discharge of said material when intially over said bag; said trapdoor is connected with a cam follower; a cam is provided to encounter said cam follower and effect opening of said trapdoor for fully discharging said material from said cavity after said material has been discharged from the rearward portion of said cavity and effect closing of said trapdoor before said cavity is moved rearward over said bottom plate for closure to receive a new load of material.

3. An apparatus for successively opening a plurality of flexible plastic bags and for holding them open while material is deposited therein, the bags being of the type that have a portion of their respective rearward sides extending above their forward sides, including in combination: a support; a carrier mounted for horizontal reciprocation on said support, said carrier having a cavity for holding a measured quantity of material therewithin and having an aperture for depositing said material in said bag after opening of said bag; means for moving said carrier reciprocally of said support; means for supporting a plurality of flattened bags of the aforesaid type beneath said carrier so that the forward bag has its extending portion inclined upwardly and rearwardly of the remainder of the bag; the improvement comprising bag opening means for pulling forwardly and upwardly equally and simultaneously on both edges of the forward side of said bag so as to pull its bottom away from the next succeeding bag for easier filling and comprising a plurality of bag opening elements carried by the forward end of said carrier; each said bag opening element having a relatively thin lower end; said bag opening elements being disposed one on each side so as to open both edges of the forward side of said bag positively, equally, smoothly and simultaneously; actuating means for said bag opening means including mounting means for movement to move the lower end of the bag opening means downwardly into sliding contact with the inclined portion of a bag and thence along said portion downwardly into the interior of the bag to move the forward side thereof away from the rearward side to partially open the bag and to move it to and hold it in a more fully opened position only with said elements without difficulty adjustable clamping means; said actuating means including respective first cam followers connected with respective said elements and respective first cam surfaces for co-acting therewithin effecting the vertically reciprocal movement of said bag opening elements cooperatively with the reciprocal movement of said carrier and cavity from a filling position to a forward position above said open bag for discharging into said open bag and serving as means for retracting the bag opening means from the bag responsive to and coordinated with reciprocal movement of said carrier such that said bag is moved beneath the discharge portion of said carrier for filling and can be closed upon the return stroke of said carrier after having discharged said material.

4. The apparatus of claim 3 wherein each said bag opening element comprises a rod having a thin lower end, said mounting means comprises respective element mounting means mounting the rods on the carrier with said first cam followers engaging said first cam surfaces such that as the carrier moves forwardly, each rod is moved along said inclined portion of and into said bag so as to pull positively, equally and simultaneously on both edges of said forward side of said bag and subsequent to full opening of said bag and discharging of said material thereinto, said first cam surfaces are so arranged that said first cam followers move said elements rearwardly and upwardly and from said bag for releasing and setting said bag and material in a predetermined location as said carrier returns from its forward position.

5. The apparatus of claim 4 wherein there are at least two bag opening elements and they are mounted at least one on each side of the forward end of the carrier and have along their bottom front, structure with sufficient frictional engagement with said forward side to hold said forward side of said bag even after at least two pounds of material is delivered thereinto; said carrier has a trapdoor that is connected with a second cam follower and that is openable adjacent the bottom of a measuring cavity within said carrier and said elements open said bag sufficiently to allow said material to fall from the rearward portion of said cavity into said bag to ensure fully opened bag and allow said trapdoor to be opened fully for thereafter allowing the remainder of said material to fall from the forward portion of said cavity; a second cam surface is provided to open said trapdoor after the initial falling of material into said bag; and said second cam follower encounters said second cam surface to effect respective opening and closing of said trapdoor after said initial falling of material into said bag and before said carrier is returned to its filling position and responsive to said reciprocal movement of said carrier.

6. The apparatus of claim 3 wherein said combination includes a housing having a bag filling section and a bag storage section with an opening therebetween for passage of a bag from said storage section to said filling section; said means for supporting a plurality of flattened bags is provided in said bag storage section with a first bag adjacent said opening and has means for continuously moving another first bag into said position adjacent said opening as bags are used; said carrier has means for filling said bag while it is in the open position; closure means for closing said opening and movable to open said opening such that a bag can be opened and filled and also being movable to a closed position after said bag has been opened and after it has had its lower end moved away from the remaining bags; said closure means while in the closed position being between a filled bag in the filling section and the bags stored in the storage section; said closure means comprising a sliding door and means for moving the door to an open position prior to operation of said means for moving forward a bag and for moving the door toward the closed position prior to filling of the bag; heat sealing means movable, responsive to said movement of said carrier, to apply heat seal across an upper portion of the bag by pressing said upper portion of the bag against said closure means when it is in the closed position and applying heat to seal said bag; said bag having at least its upper portion of a heat sealable material; said housing including a bin for storing said material to be bagged; said bin having a lower discharge opening; said carrier being mounted in said housing below said bin and having a measuring cavity therein open at the top and bottom; said carrier being mounted in the housing for reciprocation between a rearward filling position where the cavity is in registry with the bin opening, and movable to a forward position for discharging the contents of the cavity into the bag that has been opened; means closing the bottom of the cavity while it is receiving material from the bin and while it is being moved to said discharge position and thereafter opening the bottom of the cavity; said means closing the bottom of the cavity including a bottom plate extending partly along the traverse of said carrier and a trap door mounted on the carrier adjacent the bottom of the cavity; said trapdoor being connected with a second cam follower; a second cam surface; said bottom plate not only closing said bottom of said cavity but also serving as means for holding the trapdoor in a closed position as the carriage moves toward the forward discharge position and permitting the trapdoor to open when the carrier moves to said discharge position; said second cam follower and said second cam surface coacting to open said trapdoor after said aperture has moved past said bottom plate and delivered said material from the rearward side of said cavity into said open bag and serving as means for moving the trapdoor to a closed position prior to the return of the carrier to its filling position; said second cam surface for said trapdoor being disposed so as to avoid said first cam followers on said elements and said second cam followers connected with trapdoor being so located as not to be operated by said first cam surfaces for said elements such that no adjustments need be made in the field in operating of said apparatus, the factory adjustment being sufficient.

7. The apparatus of claim 6 wherein said trapdoor is mounted on said carrier exteriorly of its sald measuring cavity so as to prevent build up of soft ice and the like; said trapdoor being pivotally mounted on the front of caid carrier.

8. The apparatus of claim 3 wherein said carrier has a trapdoor on its bottom at the bottom of a measuring cavity; said trapdoor is hingedly mounted on the forward section of the carrier with the hinge on the exterior thereof so as to obviate difficulties with snow or the like piling up inside the measuring cavity.

* * * * *